United States Patent [19]

Kawakami

[11] 4,192,231

[45] Mar. 11, 1980

[54] WASHING APPARATUS FOR INK ROLLERS OF PRINTING MACHINE

[75] Inventor: Yoshito Kawakami, Koshigaya, Japan

[73] Assignees: Toppan Printing Co., Ltd.; Nikka Kabushiki Kaisha, both of Tokyo, Japan

[21] Appl. No.: 922,663

[22] Filed: Jul. 7, 1978

[30] Foreign Application Priority Data

Jul. 9, 1977 [JP] Japan ..... 52-82166

[51] Int. Cl.[2] ..... B41F 35/04; B41L 41/04

[52] U.S. Cl. ..... 101/425; 101/169

[58] Field of Search ..... 101/425, 423, 424, 349, 101/365, 366, 350, 364, 157, 169; 15/256.5, 256.51, 256.52; 134/151; 118/70, 261

[56] References Cited

U.S. PATENT DOCUMENTS

| | | | |
|---|---|---|---|
| 2,704,029 | 3/1955 | George | 101/425 |
| 3,735,702 | 5/1973 | Kossak | 101/425 |
| 3,749,014 | 7/1973 | Gates | 101/425 |
| 3,835,779 | 9/1974 | Ross et al. | 101/425 |

FOREIGN PATENT DOCUMENTS

| | | | |
|---|---|---|---|
| 2715445 | 10/1977 | Fed. Rep. of Germany | 101/425 |

*Primary Examiner*—J. Reed Fisher

*Attorney, Agent, or Firm*—Fleit & Jacobson

[57] ABSTRACT

An automatic washing apparatus for an inking arrangement is provided. The apparatus comprises a washing vessel which contains a brush device, a washing pipe and a doctor blade. The washing vessel is openable and the doctor blade is moved toward and away from a roller of the inking arrangement. Ink and foreign matter adhered to the roller are removed by the doctor blade. The doctor blade is reciprocated either linearly or circularly so that same is scraped by the brush device, whereby the ink and foreign matter adhered to the doctor blade are washed out.

10 Claims, 12 Drawing Figures

WASHING APPARATUS FOR INK ROLLERS OF PRINTING MACHINE

BACKGROUND OF THE INVENTION

The present invention relates to an apparatus for washing an inking arrangement of a printing machine, and more particularly to an apparatus for automatically washing a doctor blade for removing ink from ink rollers of the inking arrangement.

An inking arrangement is used for distributing ink, which is transferred from an ink fountain to a rolling surface of a form cylinder. The inking arrangement generally contains an ink fountain roller within the ink fountain, an ink ductor (i.e. feeder roller) which intermittently swings and delivers the ink, a plurality of ink distributing rollers, and an inking roller (i.e. form roller) which contacts the form cylinder. When particles of foreign matter such as dusts, paper fluff, anti-offset powder, etc. are adhered to a roller or rollers of the inking arrangement, the printed materials lack clarity and the final printed result is imperfect caused by the particles, because the desired printing does not come out well. Therefore, the rollers must be washed so as to remove the particles. Further, the rollers should be washed every time when colors of colorprinting are changed. In general, the washing operation is carried out once or twice a day, but a number of washing operations are needed when multi-color printing, such as four-color or six-color printing, is carried out because the multi-color printing needs the same number of inking arrangements as the number of colors. Additionally, when ink is to be changed in such a case that a special ink is used, another washing should be carried out.

Conventionally, an ink roller washing apparatus is known in which a doctor blade is fixed to a washing vessel. According to the conventional washing apparatus, communication between an ink ductor and other ink distributing rollers is first shut off, and inking roller (i.e. feeder roller) is spaced apart from a rolling surface of a form cylinder. While the inking roller is sustained from the rolling surface of the form cylinder, the aforementioned washing apparatus is manually installed on the inking arrangement so that a tip of the doctor blade may contact an ink roller. Then the rollers of the inking arrangement are rotated while washing liquid is poured from the above to remove or wash out a foreign matter as well as ink which is adhered to the rolling surface of the ink roller by means of the doctor blade. Ink and foreign matter removed by the doctor blade are transferred to the washing vessel. Foreign matter as well as ink both of which are adhered to the rolling surface of the other rollers of the inking arrangement, is transferred in turn to the cleaned ink rollers. Thus, all of the rollers of the inking arrangement are washed and cleaned.

According to the aforementioned conventional washing apparatus which should be manually installed and removed every time when washing is needed and finished, respectively, the working of installation and removal of the apparatus is quite troublesome and inefficient running of the printing machine results. Particularly when the washing apparatus is removed, it is not only troublesome to manually carry the vessel in which a great amount of used washing liquid is contained, but also likely that the washing liquid splashes to soil the elements of the printing machine when the vessel is being carried by an operational personnel. Further, ink adhered to the doctor blade should be washed out separately by the use of a suitable solvent. Thus, the conventional washing apparatus not only requires awkwardly troublesome working and operation but also results in dirt or soil of operating personnel's clothing and hands as well as of printing machine. This is likely to cause the operating personnel to shorten or abbreviate some of the washing operations, with the result of deterioration of the printed products. Furthermore, since the washing operation is carried out adjacent rotating rollers, severe dangers to the operating personnel may result. Moreover, it takes a long time to complete the washing operation, resulting in an inefficiency of a printing operation.

SUMMARY OF THE INVENTION

An object of the present invention is to provide an improved apparatus for washing an inking arrangement of a printing machine.

Another object of the present invention is to provide an improved apparatus for washing a doctor blade of washing apparatus of an inking arrangment.

A further object of the present invention is to provide an improved apparatus for automatically washing the doctor blade.

Yet another object of the present invention is to provide an improved apparatus for washing the doctor blade, which permits a simple and ready washing operation without encountering soil of operating personnel's clothing and hands.

Another object of the present invention is to provide a washing apparatus which permits an efficient washing operation, thus assuring economy and efficiency in printing products.

Briefly, in the present invention there is provided a washing apparatus for an inking arrangement of a printing machine, comprising a washing vessel which is openable and in parallel with an axis of a vibrating roller of the arrangement, a doctor blade, means for reciprocating linearly or circularly the doctor blade, brush means which contact the doctor blade when latter is moved, and means for spraying washing liquid to the brush device. The doctor blade is cleaned by means of the brush device while it is reciprocated and scrubbed by the brush means.

Other objects and features of the present invention will become apparent from the detailed description of preferred embodiments thereof, which will be read with reference to the accompanying drawings.

DESCRIPTION OF THE PREFERRED EMBODIMENTS

Figures 1, 2, 5:
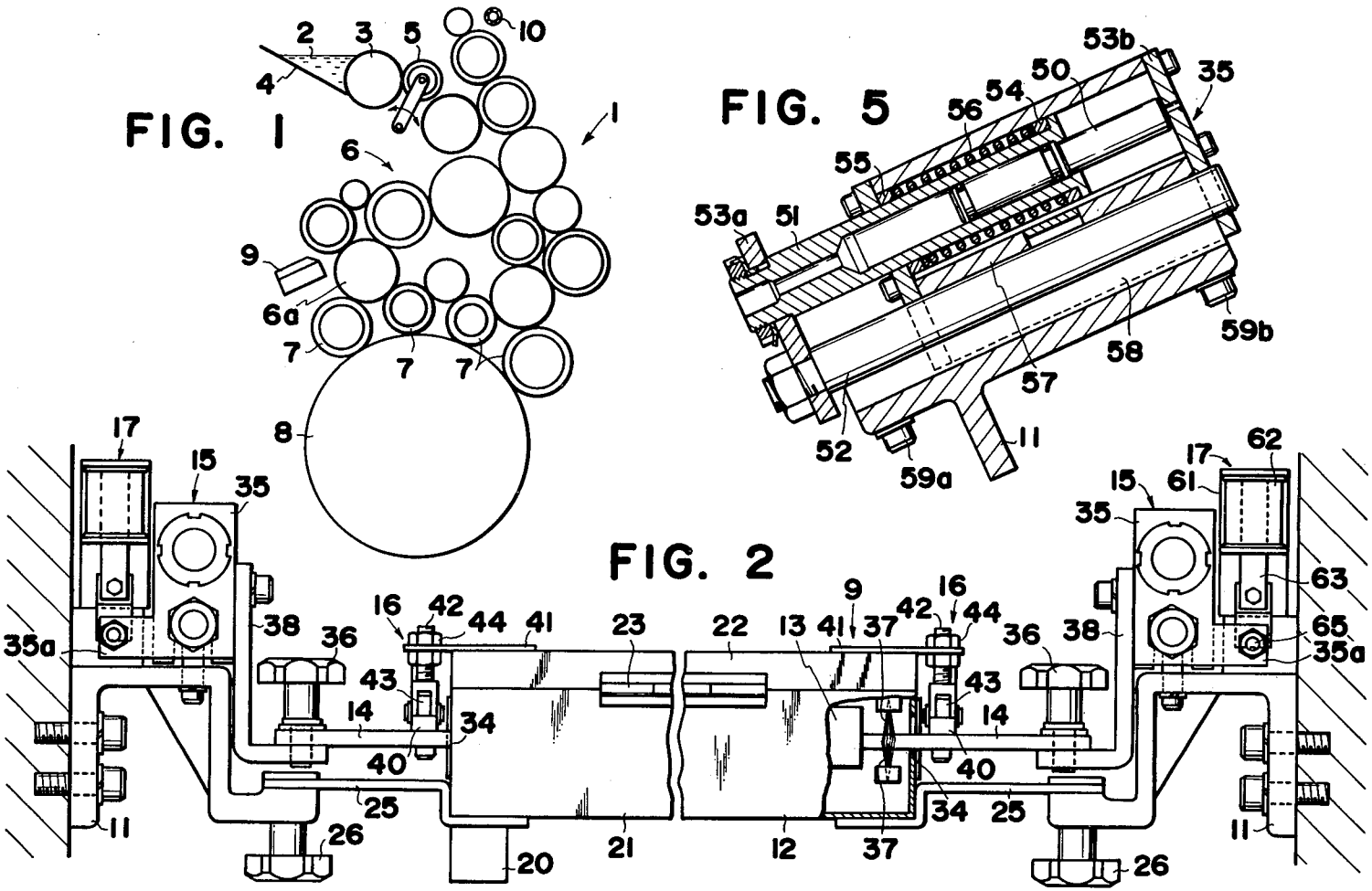
FIG. 1 is an explanatory view of general structure of an inking arrangement.
FIG. 2 is a partly fragmented back view of the washing apparatus according to an embodiment of the present invention.
FIG. 5 is a sectioned view of an oil pressure cylinder device for advancing a doctor blade.

An inking arrangement, which is generally indicated by reference numeral 1 and is known in the art, will be first described hereinafter with reference to FIG. 1. Between an ink fountain roller 3 (namely, duct roller) and an ink knife 4 is fed printing ink 2 in the form of a thin film. Ink is then transferred to ink distributing rollers 6 by means of an ink ductor 5 which is swung intermittently, and to inking rollers, which are generally illustrated at 7, and then to a form cylinder 8. A washing apparatus 9 of the present invention is disposed in parallel with a vibrating roller 6*a* which swings in the axial direction thereof to facilitate a complete distribution of ink. Above the inking arrangement 1 is disposed a nozzle bar 10 which has a plurality of holes for spraying washing liquid onto the rollers of the inking arrangement. The nozzle bar 10 is connected to a pump (not shown) so as to either manually or automatically spray washing liquid. The structure of the inking arrangement is well known in the art and therefore any further description will not be made.

The ink roller washing apparatus, which is generally illustrated at 9 in FIG. 1, in accordance with a preferred embodiment of the present invention will be described with reference to FIGS. 2 through 4A and 4B. The washing apparatus 9 is symmetrical, and structures of right and left parts of the apparatus may be considered to be identical in construction and for this reason same reference numerals are affixed to the elements of the symmetrical structures.

Principally, as illustrated in FIG. 2, the washing apparatus 9 has brackets 11 fixed adjacent to both sides of the aforementioned vibrating roller 6*a*, a washing vessel 12 supported in parallel with an axis of the vibrating roller 6*a* by means of the brackets 11, an oil cylinder system 15 which is designed to drive a base 13 of a doctor blade 18 (shown in FIGS. 3A and 3B), a mechanism 16 which cooperates with the doctor blade 18 to open and close the washing vessel 12, and a stopper device 17 for controlling the movement of the doctor blade 18 as well as the base 13. The base 13 has extensions 14 which extend in the opposite direction and are connected to the oil cylinder system 15.

Figure 3A:
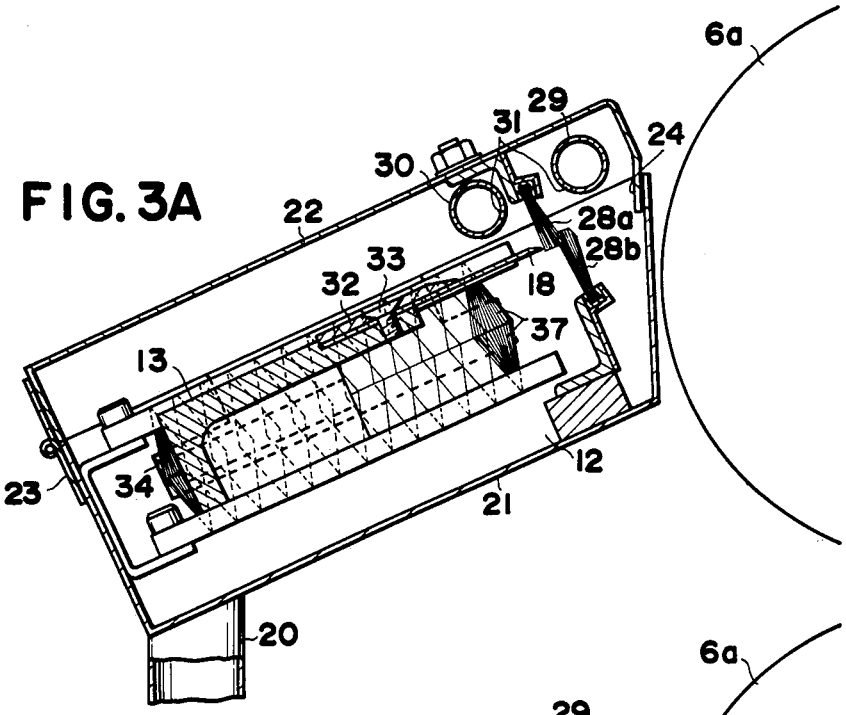
FIG. 3A is a side view of a washing vessel shown in FIG. 2, wherein the vessel is closed and a doctor blade is retracted to an original position.
Figure 3B:
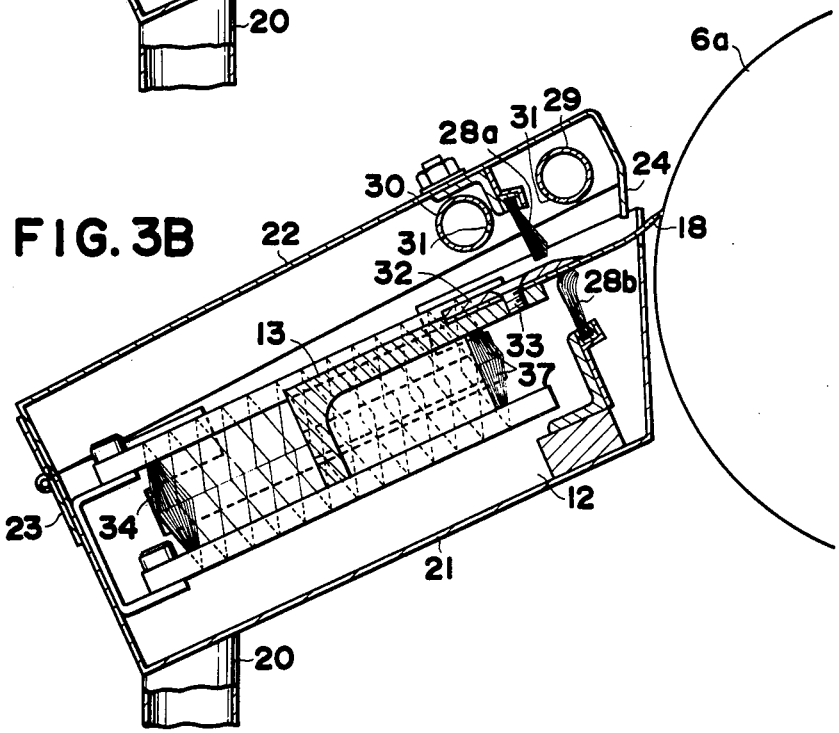
FIG. 3B is a side view of the washing vessel wherein the vessel is opened and a doctor blade is advanced so as to contact with a rolling surface of a vibrating roller.

Referring to FIGS. 2, 3A and 3B, showing that the vessel 12 is closed in FIG. 3A and opened in FIG. 3B, the washing vessel 12 is formed with a tub 21 which has an exhaustion nozzle 20 at its side, and a cover 22 which is connected with the tub by means of a hinge 23 so that the washing vessel is openable at the side 24 thereof which confronts the vibrating roller 6*a*. The tub 21 is fixedly supported on the brackets 11 by means of supporting members 25 and handles 26, the former extending in the opposite direction and being connected with bottom of the tub 21 as shown in FIG. 2. Position of the washing vessel 12 is adjustable by means of the handle 26. Within the tub 21 is disposed a lower brush 28*b* adjacent the vessel side 24 which confronts the vibrating roller 6*a*, and similarly an upper brush 28*a* is disposed within the cover 22. Washing pipes 29, 30 are disposed at the both sides of the upper brush. The washing pipes are connected to a pump device (not shown) by way of a flow-control valve (not shown), and have a plurality of holes or nozzles 31 so that washing liquid is sprayed to the upper brush 28*a* and then to the lower brush 28*b*. If needed, additional washing pipe may be provided in the vicinity of the lower brush 28*b*. The upper and lower brushes 28*a*, 28*b* are slightly overlapped with each other at the tip portion thereof so as to fully contact the upper and lower surfaces of the doctor blade 18 which is designed to be very thin. The doctor blade 18 is made of resilient materials as synthetic resins, such as polycarbonate, so that it does not injure the rolling surface of the vibrating roller 6*a*. The doctor blade 18 has a thickness of about 1.0 mm and is tapered or thinned further at the tip portion. The doctor blade 18 is detachably connected to the base 13 by means of a holder 32 and a screw 33. At the opposite sides of the vessel 12 are provided openings 34, through which extend the aforementioned extensions 14 of the base 13. The extensions 14 are fixed by means of handles 36 to arms 38 which are fixed to movable bodies 35, which will be described later with reference to FIG. 5. The handles 36 have a function for positional adjustment of the base 13.

Within the washing vessel 12 there are disposed side brushes 37 which closely contact the extension 14 of the base 13, as illustrated in FIG. 2 to prevent undesired sidewise splashing of the washing liquid out of the vessel. The base 13 as well as the doctor blade 18 are movable toward and away from the rolling surface of the vibrating roller 6*a*. During the reciprocal movement of the doctor blade 18, the upper and lower surface thereof are closely and firmly contacted with, and scrubbed by, the upper and lower brushes 28*a*, 28*b*, respectively. Thus, foreign matter and/or used ink is washed out by the scrubbing between the doctor blade 18 and the brushes 28*a*, 28*b*.

Figure 4A:
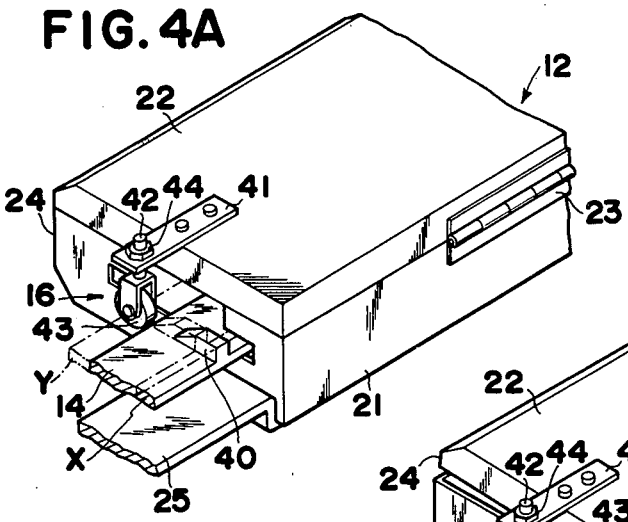
FIGS. 4A and 4B are fragmented perspective views of a washing vessel, showing an open-close mechanism of the washing vessel, in which the vessel is closed in FIG. 4A and opened in FIG. 4B for purpose of an advance of a doctor blade.
Figure 4B:
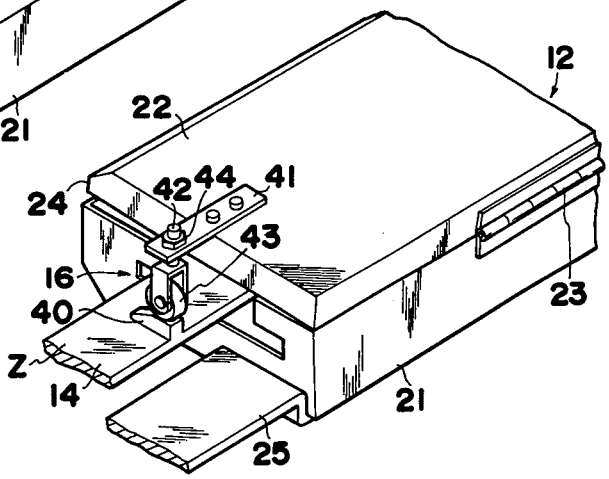

The aforementioned mechanism 16, which cooperates with the doctor blade 18 to open and close the cover 22 of the washing vessel 12, will be described with reference to FIGS. 4A and 4B. The mechanism is symmetrical and for this reason one side of the mechanism will be described in detail. In the drawing of FIGS. 4A and 4B, a trapezoidal translation cam 40 is disposed on the upper surface of the extension 14 of the base 13. A longitudinal plate 41 is connected at its one end portion to the upper surface of the cover 22 such that the plate 41 extends beyond the cover. A shaft 42 is adjustably and vertically connected to the other end portion of the plate 41 and has a roller 43 at its lowest portion. It should be recognized that position of the roller 43 is determined relative to the aforementioned translation cam 40 so that roller 43 may be positioned on the cam 40 when the extension 14 of the base as well as the doctor blade 32 is moved toward the vibrating roller 6*a*. As far as the extension 14 of the base 13 is moved toward the roller 6*a* to an extent from a position (X) shown by a solid line to a position (Y) shown by a phantom line of FIG. 4A, the mechanism 16, which cooperates with the doctor blade 18 to open and close the cover 22, does not run and maintains the cover still closed. When the extension 14 is further moved beyond the phantom lined position (Y) of FIG. 4A, the roller 43 is then positioned on a slant area of the translation cam 40 to shift upward the shaft 42 and thus the plate 41, with the result of an initiation of cover opening. When the extension 14 is moved to the predetermined extremity which is the position (Z) of FIG. 4B, the cover 22 is opened so that the doctor blade 18 is projected or advanced from the opening of the vessel 12. The shaft 42 connected to the plate 41 is adjustable by means of a nut 44, which allows adjustment of opening of the cover 22.

A hydraulic cylinder system 15 (FIG. 2) which drives the base 13 of the doctor blade 18 will be described in more detail with reference to FIG. 5. A cylinder 51 into which a piston 50 is inserted and a guide rail 52 are held at the opposite end portions thereof by means of holders 53*a* and 53*b*. These elements of the cylinder system 15 are contained within the aforementioned movable body 35 which is formed in the shape of a box so that it may fully cover the elements of the cylinder system 15. An end of the piston 50 is contacted with a front inner wall (not shown) of the movable body 35 so that the piston may thrust the movable body 35 together with the base 13 and the doctor blade 18 toward the rolling surface of the vibrating roller 6*a*. A spring 56 is provided between a cylinder collar 54 and a movable body collar 55, and a linear motion bearing 57 is disposed around the guide rail 52, which is fixed on the bracket 11 by means of bolts 59*a* and 59*b*. When hydraulic pressure is urged to the cylinder 51 from an oil pressure equipment (not shown) after an electromagnetic directional control valve (not shown) is operated, the piston 50 is driven to thrust the movable body 35 toward the vibrating roller 6*a* along the guide rail 52. Thus, the doctor blade 18 and the base 13 are moved toward the rolling surface of the vibrating roller 6*a*. When the oil pressure within the cylinder 51 is released by driving the directional control valve, the movable body 35 is retracted to the original position by the force of the spring 56. Thus, the doctor blade 18 and the base 13 are retracted.

A stopper device, which is generally illustrated by reference numeral 17 in FIG. 2, for controlling the movement of the movable body 35 as well as the doctor blade 18 will be described with reference to FIGS. 6A and 6B. On the bracket 11 is disposed a base member 60 which has a pillar 61. The pillar 61 is L-shaped in section as illustrated and detachably connected to the base member 60. The pillar is provided with a solenoid 62 which has a solenoid pin 63. The solenoid pin 63 is connected to a block 64 which is cubic and is slidable on a surface 60*a* of the base member 60 by actuation of the solenoid 62 and functions as a scrubstopper. The movable body 35 (FIG. 2) has a stopper bolt 65, one end of which confronts with the surface 60*a* of the base member 60. The stopper bolt 65 is adjustably connected to the movable member 35*a* of the movable body 35 so that termination of the movable body can be adjusted.

Figure 6A:
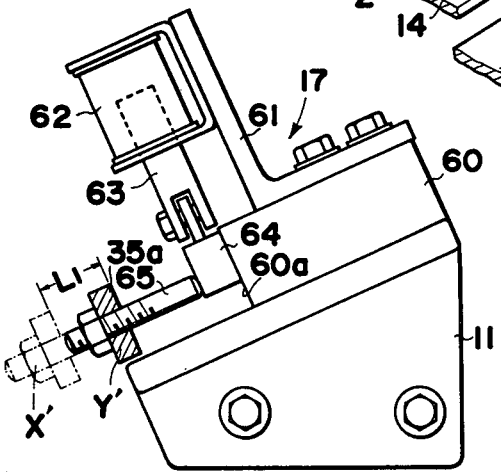
FIGS. 6A and 6B are explanatory views of a stopper mechanism which controls the advance of the doctor blade.

While an electric power is not supplied to the solenoid, the solenoid pin 63 is extended downward to maintain the block 64 at a lower position as illustrated in FIG. 6A. In this instance, the movable member 35*a* and the bolt 65 can be moved from the position (X') shown by phantom lines to the position (Y') where the stopper bolt 65 contacts the block 64 as shown by solid lines in FIG. 6A. Thus, the movable member 35*a* as well as the stopper bolt 65 can be moved within the distance shown by $L_1$ in FIG. 6A. The phantom lined position (X') is considered to be a position when the movable body 35 of the oil pressure cylinder system 15 is retracted to the utmost limit, and is correspondent to the solid line position (X) of the extension 14 of the base shown in FIG. 4A. Similarly, the solid lined position (Y') of the movable member 35*a*, which is shown in FIG. 6A, is correspondent to the phantom lined position (Y) of FIG. 4A. Accordingly, movement of the stopper bolt 65 and movable member 35*a* within the distance $L_1$ does not make the cover 22 of the washing vessel 12 open, but still maintains the cover closed.

Figure 6B:
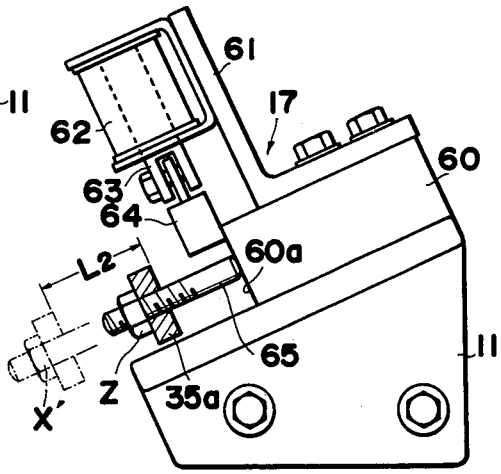

When an electric current is applied to the solenoid 62, the solenoid pin 63 and the block 64 are shifted upward as shown in FIG. 6B, and the movable member 35*a* can be moved to an extent that the stopper bolt 65 contacts the surface 60*a* of the base member 60. Namely, the movable member 35*a* is moved within the distance shown by $L_2$ of FIG. 6B. The position (Z) of the stopper bolt shown by a solid line in FIG. 6B corresponds to the position of the extension 14 which has been moved to its extremity as shown in FIG. 4B, and corresponds to the case when the doctor blade 18 extends from the opened washing vessel 12 and contacts the rolling surface of ink roller as shown in FIG. 3B.

An operational mode of the inventive washing apparatus 9 will be described. In FIG. 1, an intermittent swinging movement of the ink ductor 5 is stopped, and the ink fountain roller 3 within the ink fountain 2 and the other distributing rollers 6 are disconnected. The ink distributing rollers are rotated in the condition that the inking rollers 7 are disconnected with a form cylinder 8. The above-described operation is the same as the operation of the conventional apparatus. Though the inventive washing apparatus is operable either manually or automatically, an automatic operation of sequential control by a programme timer will be described hereinafter with reference to a time-table of FIG. 7. Description as to specific electric circuits will not be made as the same will be apparent to the skilled in the art from the following description of the operational mode.

Figure 7:
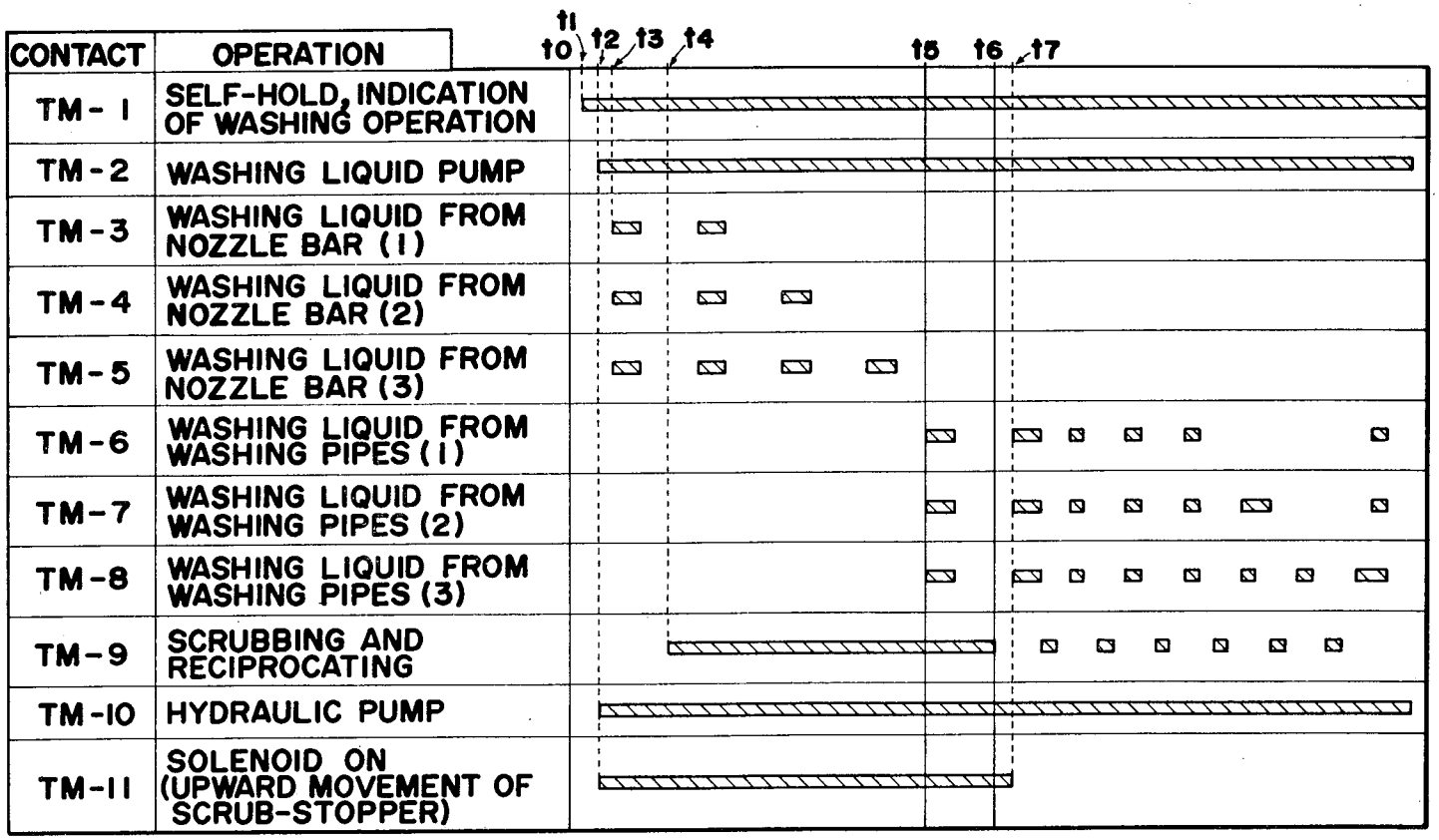
FIG. 7 is a diagram which shows an operational mode of the inventive washing apparatus.

When an electrical power source switch, driving switch, etc., (not shown) are switched on at the time $t_0$, a contact TM-1 is affected to "self-hold" the washing apparatus, and a washing indication lamp (not shown) is lighted. In FIG. 7 slant-line belts indicate that the elements are in operation. As the time $t_2$, a washing liquid pump (not shown) which is connected to a contact TM-2, and an oil pressure pump (not shown) which is connected to a contact TM-10 are driven to complete a preparation of washing liquid spraying and doctor blade advancing. Then, at the time $t_3$, a valve of the nozzle bar 10 is opened to intermittently spray the washing liquid which contains petrochemical solvent to thereby dissolve the ink adhered to the rolling surface of the ink distributing rollers while these rollers are being rotated. There are three patterns of spraying of washing liquid, and a desired pattern can be selected from two-time spraying by use of a timer contact TM-3, three-time spraying by TM-4 and four-time spraying by TM-5, in accordance with the degree of contamination or dirt of the rollers. Naturally, spraying time and non-spraying time can be prefixed. From time $t_4$ to time $t_6$ a scrubbing movement is carried out. In other words, at the time $t_4$, the directional control valve is driven so that driving oil is fed to the hydraulic cylinder 51. At this time, since an electric current is fed to the solenoid 62, the block 64 is maintained at the upward position as shown in FIG. 6B whereas the movable body 35 of the oil pressure cylinder mechanism 15 is urged to move forward until the stopper bolt 65 of the movable member 35*a* contacts the base member 60. Therefore, a combined structure of the movable body 35, arm member 38 and doctor blade base extension 14 is urged forward to affect the open-close mechanism 16. To be more specific, rollers 43 of the cover 22 are forced to be positioned on the translation cams 40 of the extended portions 14 of the doctor blade base to open the cover 22, and thus the doctor blade 18 is advanced from the opened vessel until the doctor blade is fully contacted with the rolling surface of the ink roller. Thus, used ink and washing liquid adhered to the ink roller are wiped out to be fed into the washing vessel 21.

Wasted washing liquid in the washing vessel 21 is discharged out of the vessel 12 through the exhaustion nozzle 20. In FIG. 7 it is shown that washing pipes 29, 30 in the vessel 12 spray the washing liquid at the time $t_5$, which is within the interval of the scrubbing movement of the doctor blade, so that the brushes 28*a*, 28*b* are wetted. The spraying operation is controlled by contacts TM-6, TM-7, or TM-8, which can be selected in accordance with dirt or contamination of the doctor blade 18. Thus, the spraying operation of the washing liquid is carried out at the predetermined timing. At the time $t_6$, the scrubbing movement is stopped. Namely, when the directional control valve is driven so that the oil pressure of the hydraulic cylinder 51 is released, the movable body 35 is retracted to the original position by the force of the spring 56 to thereby retract the arms 38, base 13, doctor blade 18, etc. and close the cover 22 of the washing vessel 12.

At the time $t_7$, supply of an electric current to the solenoid 62 is stopped to allow the block 64 to fall down as shown in FIG. 6A. Thus, when the cylinder 51 is intermittently operated by driving the directional control valve, the open-close mechanism 16 is not operated because the movable distance of the stopper bolt 65 is limited to the distance $L_1$, and the washing vessel 12 maintains the cover 22 closed. The doctor blade 32 which is contacted with the upper and lower brushes 28*a*, 28*b* is reciprocated, while the cover 22 is closed. At a suitable timing of the above-described reciprocal movement, washing liquid is sprayed from the washing pipes 29, 30 to automatically wash the doctor blade 18 within the washing vessel 12.

The liquid containing used ink exhausted out of the washing vessel 12 is preferably fed to a suitable treatment device (not shown).

Figure 8A:
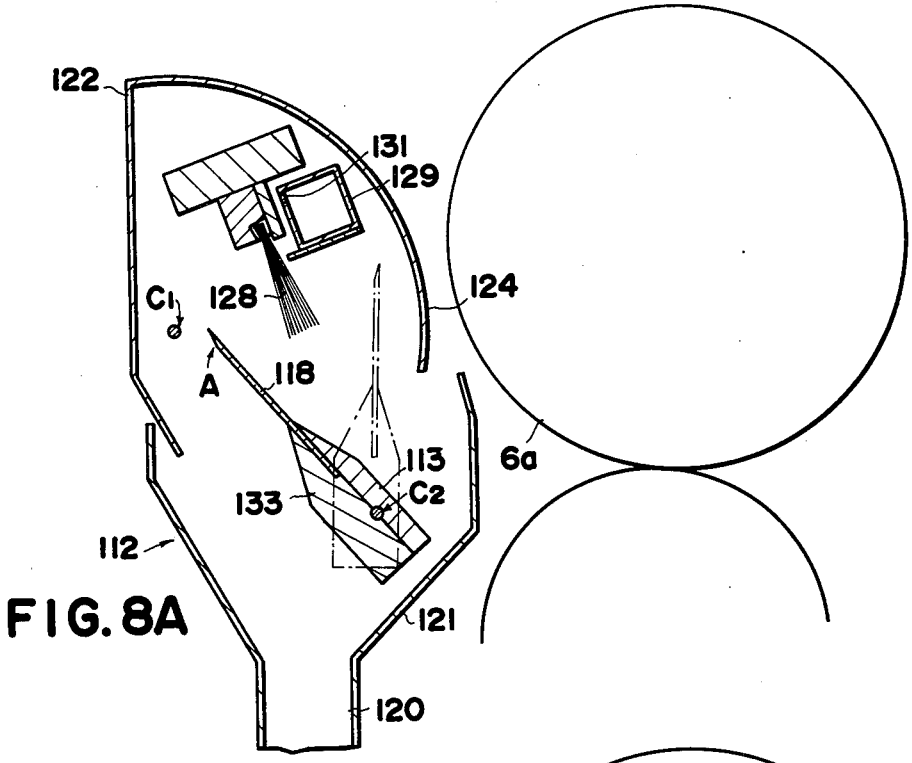
FIG. 8A is a side view of a washing vessel in another embodiment of the present invention, wherein the vessel is closed.
Figure 8B:
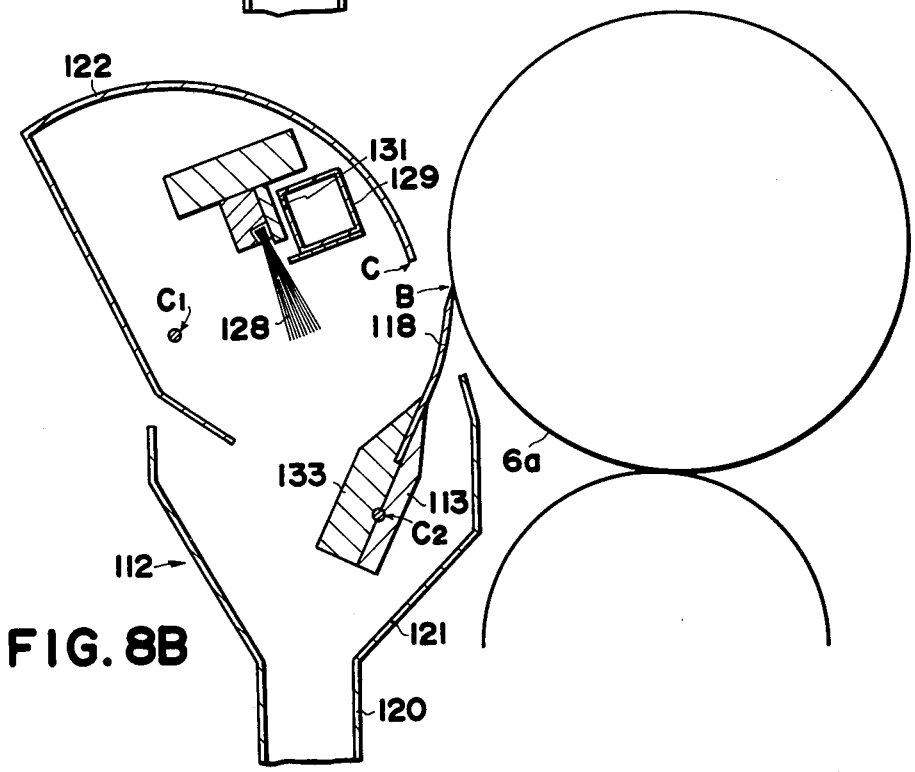
FIG. 8B is a side view of the washing vessel, wherein the vessel is opened and the doctor blade contacts a rolling surface of the vibrating roller.

In FIGS. 8A and 8B, which show a washing vessel 112 in another embodiment of the present invention, the washing vessel 112 has a tub 121 and a cover 122. The vessel 121 is pivotally connected with the cover 122 at $C_1$ so that the cover may be opened at the side 124 which confronts the vibrating roller 6*a* by means of a desired actuator such as a hydraulic motor and a hydraulic cylinder. In this embodiment, the tub 121 is fixed to the brackets, which are shown in FIG. 2. Above the tub 121 is disposed a brush 128 and a washing pipe 129, the latter having a plurality of nozzles for spraying washing liquid to the brush 128. A doctor blade 118, which is quite similar in structure with that of the preceding embodiment, is detachably connected to a base 113 by means of a securing member 133 within the washing vessel 112. The base 113 on which is connected the doctor blade 118 is rotatable at its longitudinal axis $C_2$. Thus, the doctor blade can be moved between a position A in the washing vessel 112 and a position B where the doctor blade contacts the rolling surface of the vibrating roller 6*a*. The doctor blade 118 is scrubbed by the brush 128 while the same is reciprocated circularly between positions A and C. The reciprocal movement of the doctor blade 118 can be driven by means of a desired actuator such as a hydraulic motor, hydraulic cylinder or any other desired devices, and controlled by means of a suitable stopper system so that the doctor blade 118 is reciprocated at $C_2$ between position A and position C while the cover 121 is being closed.

An operational mode will be described. Referring first to FIG. 1, an intermittent movement of the ink ductor 5 is stopped, and the connection between the ink fountain roller 3 and the other ink distributing rollers 6 is released. The ink distributing rollers 6 are rotated while the inking roller 7 is disconnected with the form cylinder 8. Then a valve (not shown) is opened to feed washing liquid containing petrochemical solvent to the nozzle bar 10. The nozzle bar 10 permits an intermittent spraying of the washing liquid to the ink distributing rollers 6 so that the ink adhered to the rollers may be dissolved.

Then, the cover 122 is opened by a driving device as illustrated in FIG. 8A and the doctor blade 118 is then advanced by means of another driving device to the rolling surface of the vibrating roller 6*a* so that the doctor blade contacts the vibrating roller at position B, as illustrated in FIG. 8B. Ink, foreign matters and washing liquid which are adhered to the rolling surface of the vibrating roller 6*a*, are scrubbed and removed by the doctor blade 118 and then exhausted out of the washing vessel 112 through a nozzle 120. After that, the doctor blade 118 is retracted to the original position within the washing vessel 122, the original position being illustrated by A, and the cover 122 is closed as illustrated in FIG. 8A.

After the cover 122 is closed, washing liquid is fed to the washing pipe 129 so as to spray the washing liquid to the brush 128. The brush is thus wetted with the washing liquid. Then, the doctor blade 118 is circularly reciprocated at point $C_2$ between the positions A and C, to thereby wash out or brush the doctor blade.

In the embodiment shown in FIGS. 8A and 8B, since the doctor blade is circularly reciprocated, namely, continuously pivoted in opposite directions about the axis $C_2$, the doctor blade is firmly contacted with, and scrubbed by, the brush 128. Further, the doctor blade is disposed obliquely relative to a vertical line of the apparatus, which permits a desired exhaustion of the washing liquid containing ink and foreign matters out of the washing vessel.

According to the washing apparatus of the present invention, a washing operation can be simplified, with the results of desired printed products. Further, the washing apparatus does not confront a dirt or contamination of operating personnel's hands and clothing. Additionally, washing can be carried out immediately after any foreign matter is found in the printed products. Further, washing time can be shortened, with the result of an efficient and economic running of the printing press.

Though the present invention has been described with reference to mere preferred embodiments, modifications and alterations may be made in respect of each of the elements in the washing apparatus. Further, an operational mode may be changed in accordance with the degree of dirt or contamination or characteristics of the ink used.

What is claimed is:

1. A washing apparatus for an inking arrangement which contains ink rollers and a vibrating roller, comprising:

(a) a washing vessel having a tub and a cover; said cover being pivotally connected with said tub so that the cover may be opened, said washing vessel containing therein a doctor blade and brush means, said brush means being fixed to said washing vessel, (b) means for supporting said washing vessel in parallel with an axis of said vibrating roller;

(c) means for moving said doctor blade toward and from a rolling surface of said vibrating roller; said means for moving the doctor blade reciprocating said doctor blade within said washing vessel after said cover is closed such that said doctor blade is scraped by said brush means, (d) means for opening said cover of the washing vessel when said doctor blade is advanced to the rotating surface of said vibrating roller and closing said cover when same is retracted within said washing vessel; and (e) pipe means having a plurality of nozzles for spraying washing liquid principally to said brush means, whereby when said doctor blade contacts the rolling surface of the vibrating roller and then retracted within said washing vessel, said cover is closed and said doctor blade is scraped by said brush means while said doctor blade is reciprocated.

2. The washing apparatus according to claim 1, in which said doctor blade is advanced and retracted linearly toward and from the rolling surface of said vibrating roller, and in which said doctor blade is linearly reciprocated within said washing vessel in contact with said brush means, thereby brushing said doctor blade.

3. The apparatus according to claim 1, in which said doctor blade is pivotally advanced and retracted toward and from the rolling surface of said vibrating roller, and in which said doctor blade is circularly reciprocated within said washing vessel, thereby brushing said doctor blade.

4. The washing apparatus according to claim 2, in which said apparatus further comprises a base member in said washing vessel, said doctor blade being secured on said base member, said base member having extended portions which extend to the outside of said washing vessel, said extended portions being connected to said means for moving the doctor blade.

5. The washing apparatus according to claim 4, in which said means for opening and closing said cover of the washing vessel comprises a translation cam fixed to each of said extended portions of the base member, and a roller which is supported by said cover such that a rolling surface of said roller is coincided with said translation cam, whereby when said extended portions are advanced, said roller is fed on said translation cam to thereby open said cover.

6. The washing apparatus according to claim 5, in which said cover has a longitudinal member extending outward of said washing vessel, said roller being rotatably connected to a shaft, said shaft being adjustably connected to said longitudinal member.

7. The washing apparatus according to claim 4, in which said means for moving said doctor blade comprises a movable body connected to said extended portions of said base member, and an hydraulic cylinder device which is connected to said means for supporting said washing vessel.

8. The washing apparatus according to claim 7, in which said means for moving said doctor blade further comprises a solenoid having a block member, and a stopper device which is in cooperation with said block member of said solenoid, said stopper device comprising a bolt which is connected to said movable body, thereby controlling the movement of said extended portions of the base member toward the rolling surface of said vibrating roller.

9. The washing apparatus according to claim 2, in which said brush means has an upper brush which extends downward, and a lower brush which extends upward, said upper and lower brushes being overlapped with each other at the tip portions thereof.

10. The washing apparatus according to claim 1, in which said doctor blade is made of polycarbonate and has a thickness of about 1.0 mm.

* * * * *